US008371630B2

(12) United States Patent
Huang et al.

(10) Patent No.: US 8,371,630 B2
(45) Date of Patent: Feb. 12, 2013

(54) AUXILIARY CARRYING DEVICE

(75) Inventors: Chien-Feng Huang, Taipei Hsien (TW); Zih-Wei Wang, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 207 days.

(21) Appl. No.: 12/977,085

(22) Filed: Dec. 23, 2010

(65) Prior Publication Data

US 2012/0085798 A1 Apr. 12, 2012

(30) Foreign Application Priority Data

Oct. 8, 2010 (TW) ..... 99134282

(51) Int. Cl.
*A45F 5/00* (2006.01)

(52) U.S. Cl. ..... 294/31.2; 220/760

(58) Field of Classification Search ..... 294/31.2, 294/34, 119.2, 155, 156, 157; 224/272; 220/764, 220/760, 757; D32/53
See application file for complete search history.

(56) References Cited

U.S. PATENT DOCUMENTS

| | | | | |
|---|---|---|---|---|
| 334,922 | A * | 1/1886 | Alston | 294/31.2 |
| 1,539,201 | A * | 5/1925 | Ottow | 294/31.2 |
| 2,999,714 | A * | 9/1961 | Ritchie | 294/31.2 |
| 3,275,366 | A * | 9/1966 | Hidding | 294/31.2 |
| 5,445,425 | A * | 8/1995 | Lyver | 294/31.2 |
| 5,501,379 | A * | 3/1996 | Munoz | 224/682 |
| 6,241,415 | B1 * | 6/2001 | Stark | 294/31.2 |

* cited by examiner

*Primary Examiner* — Paul T Chin
(74) *Attorney, Agent, or Firm* — Altis Law Group, Inc.

(57) ABSTRACT

An auxiliary carrying device for carrying an object includes a strap, a handle, and a lacing assembly. The strap surrounds the object and includes a fixing end and a free end. The free end defines a number of through holes along the length thereof. Two ends of the handle are connected to the strap. The lacing assembly includes a connecting element and an adjusting element. The connecting element is fixed to the fixing end. The adjusting element is connected to the connecting element and comprises a post. The post is capable of inserting one of the through holes to connect the free end with the connecting element.

13 Claims, 5 Drawing Sheets

AUXILIARY CARRYING DEVICE

BACKGROUND

1. Technical Field

The present disclosure relates to an auxiliary carrying device.

2. Description of Related Art

It is difficult and inconvenient to carry large, heavy fluid canisters, since a proper grip on the outer surface of the fluid canister is required.

Therefore, it is desirable to provide an auxiliary carrying device that can overcome the described limitations.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
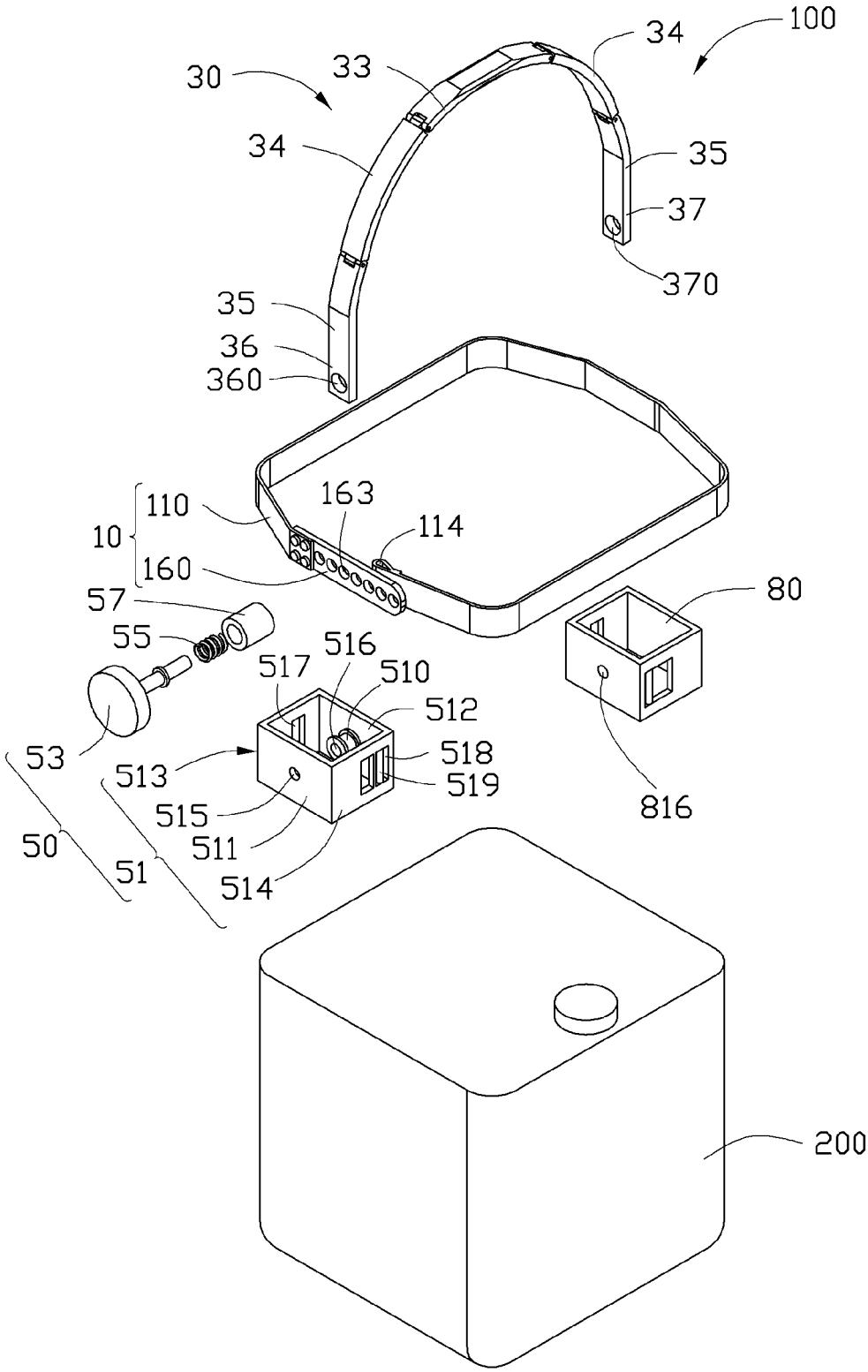
FIG. 1 is an isometric, exploded, and schematic view of an auxiliary carrying device for a fluid canister, according to an exemplary embodiment.
Figure 2:
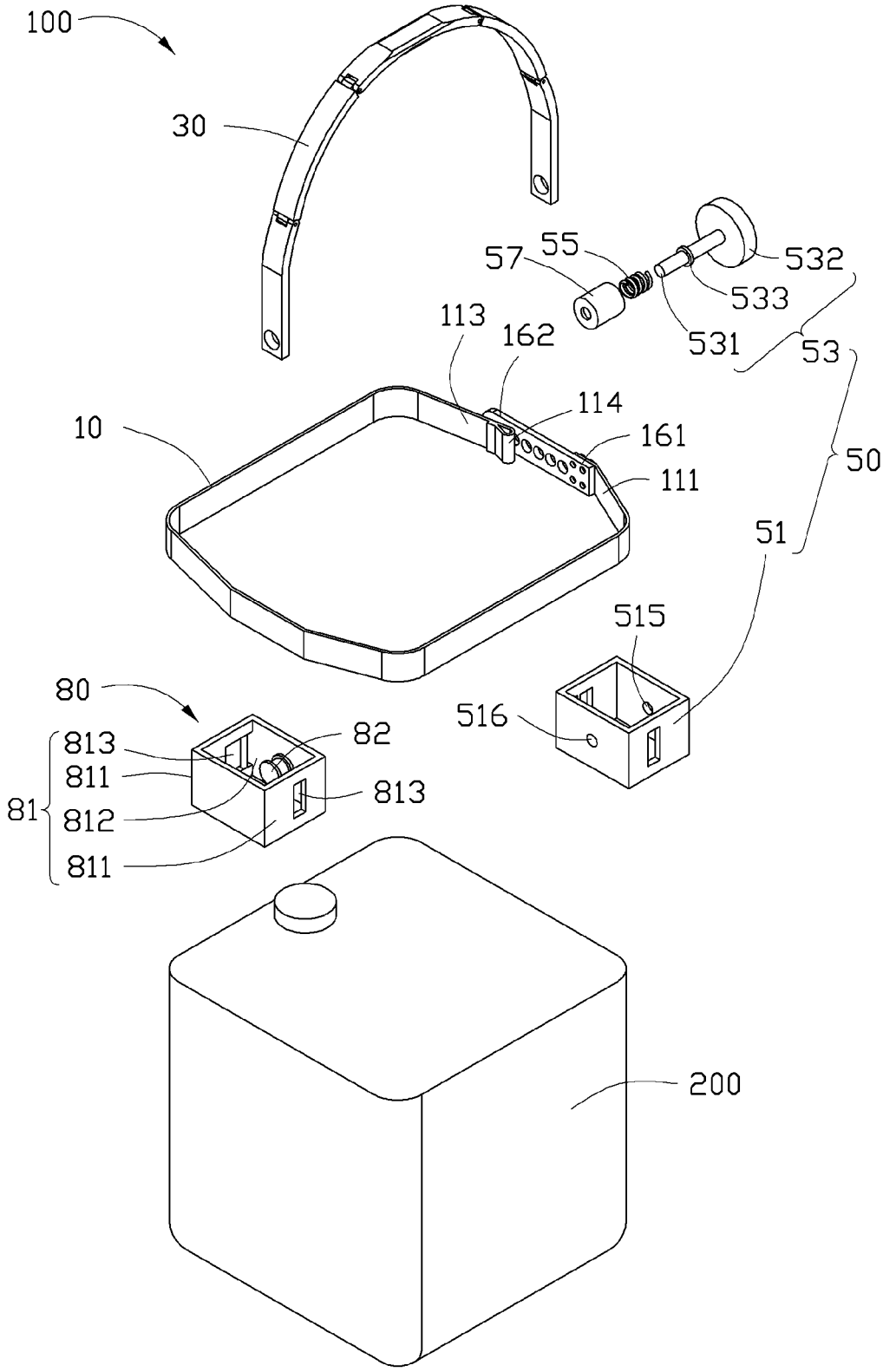
FIG. 2 is similar to FIG. 1, but viewed from another angle.

Referring to FIGS. 1-2, an auxiliary carrying device 100, according to an exemplary embodiment, is configured for an object 200 such as a fluid canister. The auxiliary carrying device 100 includes a strap 10, a handle 30, a lacing assembly 50, and a fixing assembly 80.

The strap 10 includes a fixing section 110 and an adjusting section 160. The fixing section 110 is made of flexible material, surrounding and tightly grasping the outer periphery of the object 200. The fixing section 110 includes a first connecting end 111 and a fixed end 113. The adjusting section 160 includes a second connecting end 161 and a free end 162. The first connecting end 111 is securely connected to the second connecting end 161. The adjusting section 160 defines a number of first through holes 163 along the length thereof. A surface of the fixing section 110 contacting the object 200 forms an anti-skid pattern, here a plurality of micro bumps, to increase the force of friction therebetween. In this embodiment, the adjusting section 160 is made of metal.

The handle 30 connects to the strap 10 and includes a handle chain 33, two middle chains 34, and two terminal chains 35. The two middle chains 34 respectively connect to two distal ends of the handle chain 33. Each of the two terminal chains 35 connects to an end of the corresponding middle chain 34 opposite to the handle chain 33. One terminal chain 35 has a first distal end 36 opposite to the corresponding middle chain 34, the other terminal chain 35 has a second distal end 37 opposite to the other corresponding middle chain 34. The distance between the first distal end 36 and the second distal end 37 can be changed to accommodate the object 200 of different sizes. The first distal end 36 defines a second through hole 360. The second distal end 37 defines a third through hole 370.

The lacing assembly 50 includes a first connecting element 51, an adjusting element 53 such as a rivet, a compression elastic element 55, such as a coil spring, sleeving on the adjusting element 53, and a protective cover 57, such as a tube, sleeving on the compression elastic element 55. The first connecting element 51 is hollow and cuboid in shape, and includes a first sidewall 511, a second sidewall 512 opposite to the first sidewall 511, a third sidewall 513 connecting the first and second sidewalls 511, 512, and a fourth sidewall 514 opposite to the third sidewall 513. The first sidewall 511 defines a fourth through hole 515. A protrusion 510 is positioned on the second sidewall 512 and defines a fifth through hole 516 corresponding to the fourth through hole 515. The third sidewall 513 defines a first through slot 517. The fourth sidewall 514 defines a second through slot 518 corresponding to the first through slot 518. A rod 519 is formed within the second through slot 518, and extends along the height direction of the second through slot 518. In this embodiment, the fixing end 113 of the fixing section 110 forms a fixing ring 114 sleeving on the rod 519, and thus the fixing end 113 is fixedly connected with the rod 519. The free end 162 passes through the first slot 517 and can be protruded through the second through slot 518.

The adjusting element 53 includes a post 531, a cap 532 fixed to an end of the post 531, and a baffle ring 533 sleeving and fixed to the post 531.

The fixing assembly 80 attaches the second distal end 37 of the handle 30 to the strap 10, and includes a second connecting element 81 and a fixing element 82 such as a bolt. The second connecting element 81 is a hollow cuboid and includes two opposite fifth sidewalls 811 and a sixth sidewall 812 connecting the two fifth sidewalls 811. Each fifth sidewall 811 defines a third through slot 813, through each of which the fixing section 110 passes. The sixth sidewall 812 defines a sixth through hole 816 (see FIG. 1).

Figure 3:
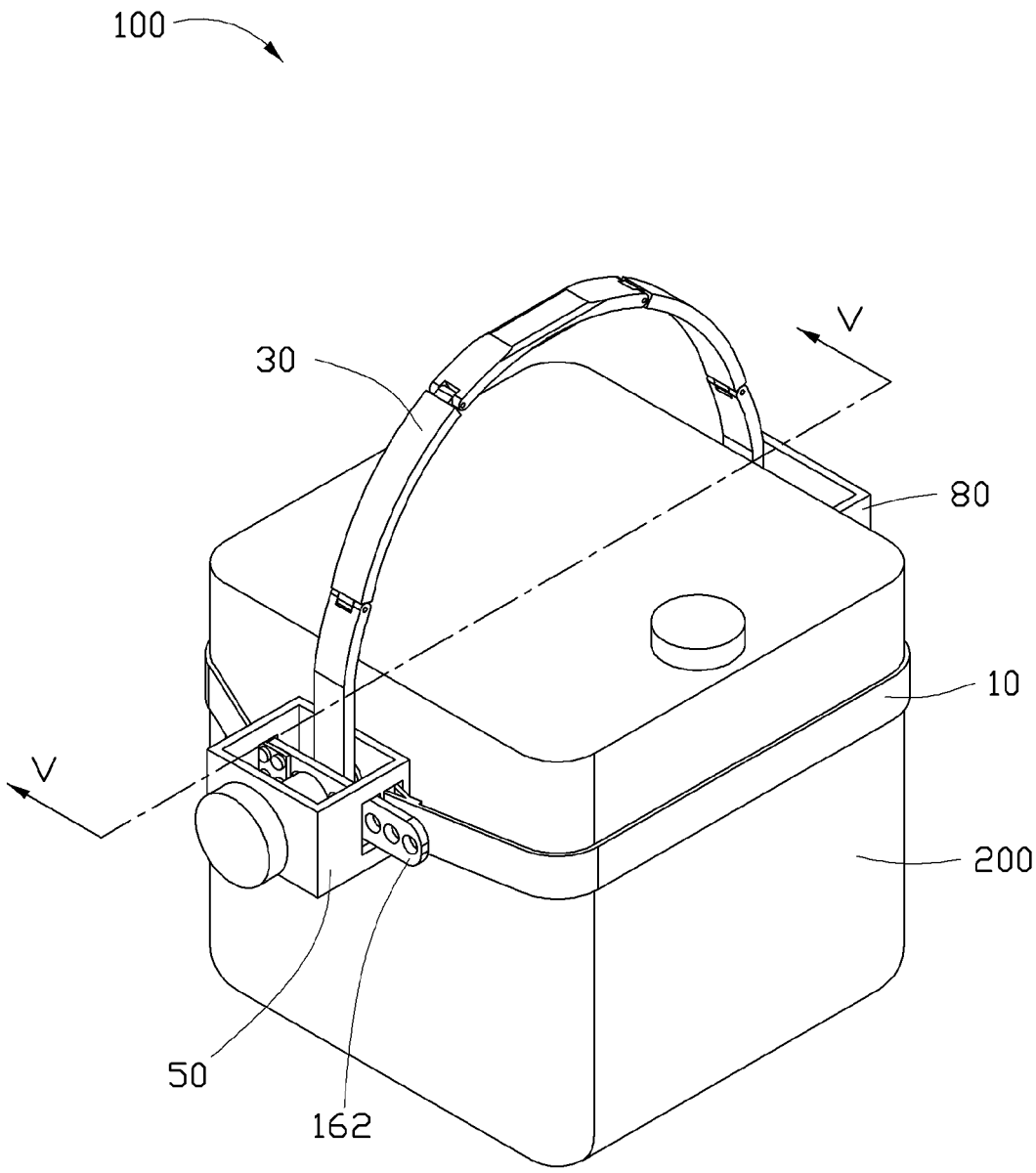
FIG. 3 is an assembled view of the auxiliary carrying device of FIG. 1, in use.
Figure 4:
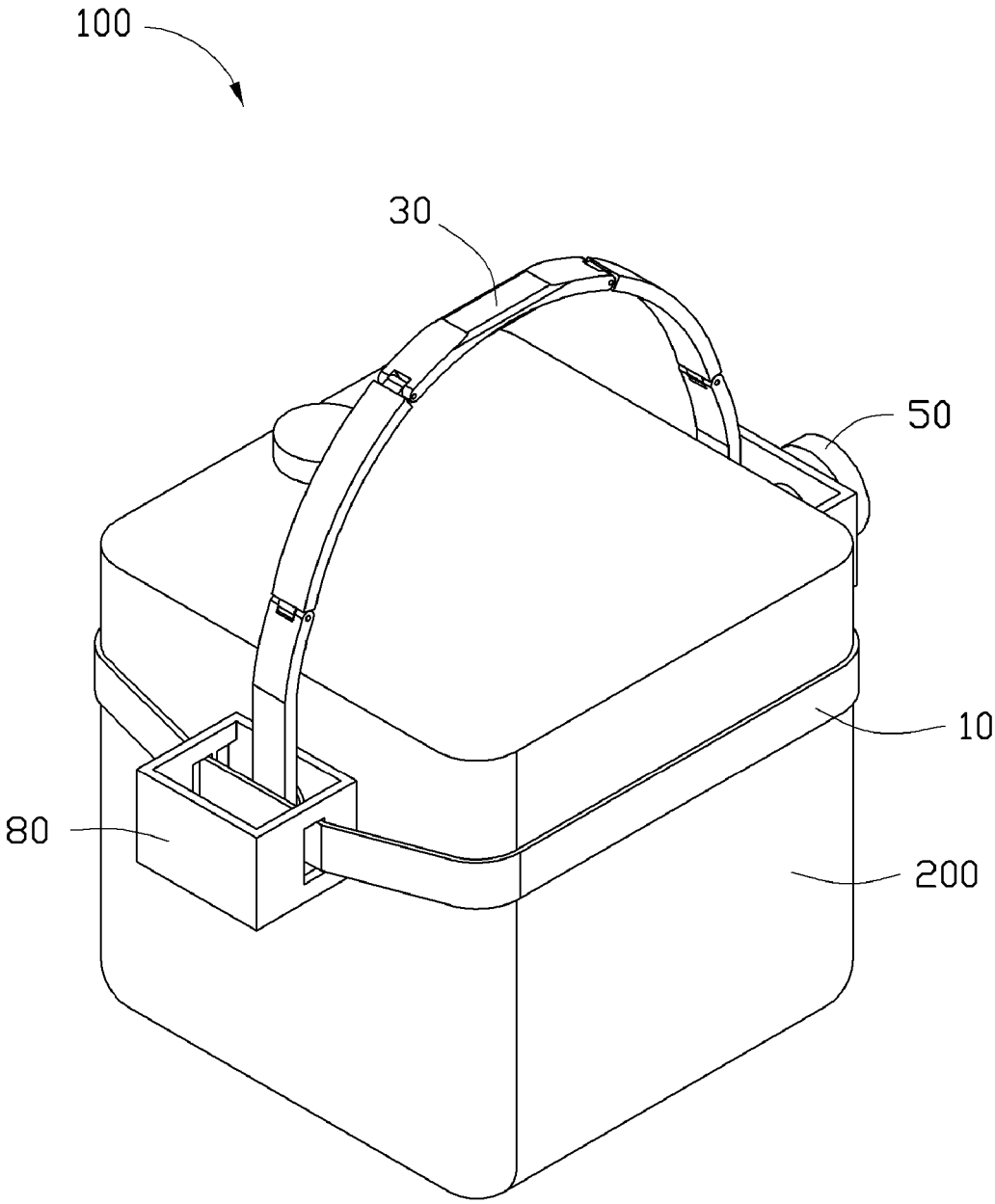
FIG. 4 is similar to FIG. 3, but viewed from another angle.
Figure 5:
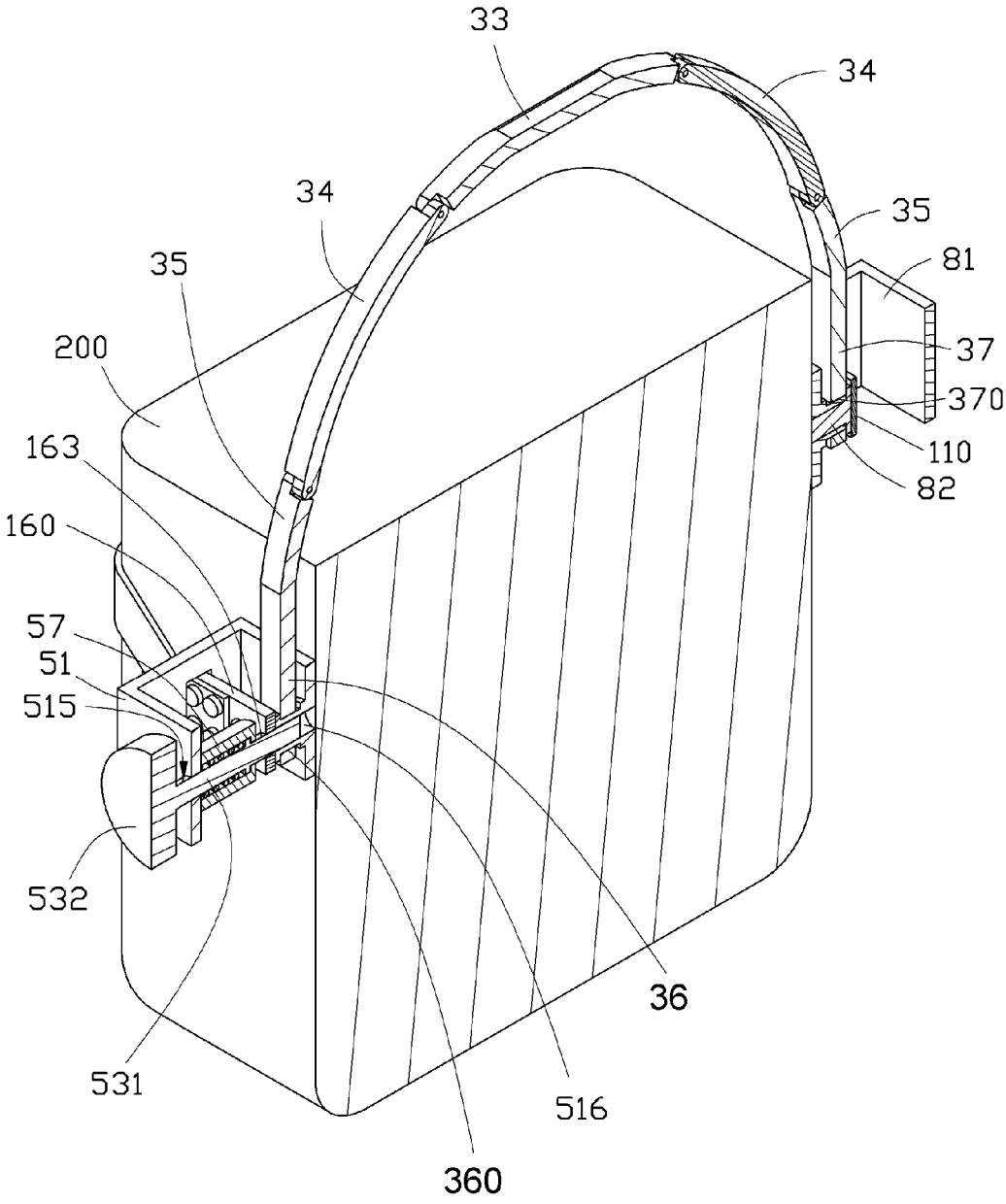
FIG. 5 is a cross-section of the auxiliary carrying device, taken along a line V-V of FIG. 3.

Also referring to FIGS. 3 through 5, in assembly, the fixing element 82 passes through the third through hole 370 and is fixed in the sixth through hole 816, and thus the second distal end 37 is fixed on the fixing assembly 80. The fixing section 110 passes through the two third though slot 813, and then the free end 162 is pulled through the first through slot 517 and the second through slot 518 sequentially and toward the fixing ring 114 until the strap 10 tightly wraps around the object 200 and one of the first through hole 163 is aligned with the fourth through hole 515 and the fifth through hole 516. The second through hole 360 accommodates the protrusion 510. The post 531 passes through the fourth through hole 515, the compression elastic element 55 sleeves on the post 531, and the baffle ring 533 sleeves over and are fixed on the post 531 such that the compression elastic element 55 is resisted by the baffle ring 533 and the first sidewall 511. The protective cover 57 sleeves over the baffle ring 533 and the compression elastic element 55.

The post 531 passes through a corresponding first through hole 163, the second through hole 360, and is received in the fifth through hole 516. The compression elastic element 55 is compressed between the first sidewall 511 and the baffle ring 533, and provides elasticity to the baffle ring 533, such that the post 531 is received in the fifth through hole 516 until the cap 532 is stopped by the first sidewall 511. Thus, the first distal end 36 is connected to the strap 10, the free end 162 is connected to the fixing end 113, thereby the strap 10 tightly wraps around the object 200. The effective length of the strap 10 wrapping on the object 200 can be adjusted by the post 531 being selectively received in a suitable first through hole 163. The protective cover 57 prevents the compression elastic element 55 from hurting the user. In other embodiments, the fixing end 113 can be fixed on the second sidewall 512 by other technologies, for example, by additional fasteners.

In other embodiments, the baffle ring 533 and the compression elastic element 55 can be omitted, the inner sidewall of the second through hole 516 defines some third threads, the outer sidewall of the post 531 defines some fourth threads, and thus the adjusting element 53 can be fixed to the first connecting element 51 by the third and fourth threads. The first distal end 36 and the second distal end 37 can alternatively be directly fixed to the strap 10 by other means, such as riveting. The handle 30 can be made of flexible material. The handle 30 can be integrally formed with the strap 10. The protrusion 510 can also be omitted, and the fourth through hole 516 directly defined on the second sidewall 512.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. An auxiliary carrying device for carrying an object, comprising:

a strap configured for surrounding the object, the strap comprising:

a fixing end; and a free end defining a plurality of first through holes along the length thereof;

a handle, wherein the handle comprises a handle chain, two middle chains, and two terminal chains, the two middle chains respectively connect to two ends of the handle chain, each of the two terminal chains connects to an end of a corresponding middle chain opposite to the handle chain, one terminal chain has a first distal end, the other terminal chain has a second distal end, the first and second distal ends are connected to the strap; and a lacing assembly comprising:

a first connecting element connecting with the fixing end; and an adjusting element positioned on the first connecting element and comprising a post, the post capable of inserting into one of the first through holes to connect the free end to the first connecting element.

2. The auxiliary carrying device of claim 1, wherein the first distal end defines a second through hole, the post passes through the second through hole such that the handle is connected to the first connecting element.

3. The auxiliary carrying device of claim 2, wherein the second distal end defines a third through hole; the auxiliary carrying device further comprises a fixing assembly, the fixing assembly comprises a second connecting element and a bolt, the second connecting element is positioned on the strap, the bolt passes through the third through hole to connect the second distal end to the second connecting element.

4. The auxiliary carrying device of claim 3, wherein the first connecting element is hollow and cuboid in shape, and comprises a first sidewall defining a fourth through hole, a second sidewall opposite to the first sidewall, a third sidewall defining a first through slot, and a fourth sidewall opposite to the third sidewall, the second sidewall defines a fifth through hole corresponding to the fourth through hole, the fourth sidewall defines a second through slot corresponding to the first through slot; the free end is capable of passing through the first through slot and the second through slot sequentially until the strap tightly wraps around the object, one of the first through holes is aligned with the fourth through hole and the fifth through hole, the post passes through the fourth, second, and first through holes, and is received in the fifth through hole, and thus the free end is fixed on the first connecting element.

5. The auxiliary carrying device of claim 4, wherein the second connecting element is hollow and cuboid in shape, and defines two third through slots, the strap passes through the two third through slots, the fixing assembly defines a sixth through hole, the second distal end is received in the second connecting element to make the third through hole aligned with the sixth through hole, the bolt passes through the second and sixth through holes to connect the second distal end to the second connecting element.

6. The auxiliary carrying device of claim 4, wherein the first connecting element comprises a rod, the rod is positioned within the second through slot and extends along a height direction of the second through slot, the fixing end has a fixing ring surrounding the rod.

7. The auxiliary carrying device of claim 4, wherein the adjusting element comprises a cap fixed to an end of the post, the cap contacts the first sidewall.

8. The auxiliary carrying device of claim 7, wherein the adjusting element comprises a baffle ring, the baffle ring accommodates and is fixed to the post, the lacing assembly further comprises a compression elastic element resisted between the baffle ring and the first sidewall, the compression elastic element is configured to provide an elastic force to the baffle ring such that the post is received in the fifth through hole and the cap is stopped by the first sidewall.

9. The auxiliary carrying device of claim 8, wherein the lacing assembly further comprises a protective cover sleeving over the compression elastic element and the baffle ring.

10. The auxiliary carrying device of claim 7, wherein the compression elastic element is a coil spring, the coil spring sleeves over the post.

11. The auxiliary carrying device of claim 7, wherein the lacing assembly comprises a protrusion positioned on the second sidewall, the fifth through hole is defined in the protrusion, the second through hole accommodates the protrusion.

12. The auxiliary carrying device of claim 1, wherein the strap comprises a fixing section and an adjusting section securely connected to the fixing section, the fixing section comprises the fixing end and a first connecting end, the adjusting section comprises the free end and a second connecting end, the second connecting end is securely connected to the second connecting end.

13. The auxiliary carrying device of claim 1, wherein the handle is made of flexible material.

* * * * *